US006938881B2

(12) United States Patent
Grapes

(10) Patent No.: US 6,938,881 B2
(45) Date of Patent: Sep. 6, 2005

(54) MANUAL MARINE WINCH WITH LEAD IN WEBBING STRAP

(76) Inventor: David B. Grapes, 39 Creighton Ave., Pittsburgh, PA (US) 15205

( * ) Notice: Subject to any disclaimer, the term of this patent is extended or adjusted under 35 U.S.C. 154(b) by 465 days.

(21) Appl. No.: 09/965,788

(22) Filed: Sep. 27, 2001

(65) Prior Publication Data

US 2003/0057409 A1 Mar. 27, 2003

(51) Int. Cl.[7] ..... B66D 1/00
(52) U.S. Cl. ..... 254/352; 254/213; 254/376
(58) Field of Search ..... 254/352, 213, 254/376; 242/378.1

(56) References Cited

U.S. PATENT DOCUMENTS 3,416,763 A * 12/1968 Moreno ..... 24/68 R
4,106,754 A * 8/1978 Kucher ..... 254/352
4,222,550 A * 9/1980 de Bosredon ..... 254/223
4,553,633 A * 11/1985 Armstrong et al. ..... 182/3
5,605,035 A * 2/1997 Pethrick et al. ..... 57/200
5,697,329 A * 12/1997 Bell et al. ..... 119/857
5,762,455 A * 6/1998 Long ..... 410/100
6,449,815 B1 * 9/2002 Spiller ..... 24/306
6,460,795 B1 * 10/2002 Brown, Jr. ..... 242/378.2
2001/0022035 A1 * 9/2001 Veloce ..... 33/758

OTHER PUBLICATIONS

Publication entitled: "Recommended Standard Specification for Winches Used With Synthetic Web Tiedowns WST-DA–T3" 16 pages. ©Web Sling & Tie Down Association, Inc. (1998).
Description entitled: "Winches & Winch Bars", KINE-DYNE® catalog, p. 49 (1998).

* cited by examiner

*Primary Examiner*—Kathy Matecki
*Assistant Examiner*—E. Langdon
(74) *Attorney, Agent, or Firm*—Blynn L. Shideler; Krisanne Shideler; BLK Law Group

(57) ABSTRACT

A manual marine winch includes a housing, a rotating drum in the housing, a drum rotating and holding mechanism, and a winch line having a lead in end formed by a webbing strap. The webbing strap can include an integral safety indicator such as load indicating indicia, operating indicia indicative of operating extremes for the webbing strap, reflective material, or abrasion resistant material. The drum may include a slot receiving the webbing strap. The winch line may include wire rope, chain or rope coupled to the webbing strap. The method of tensioning the winch line includes feeding a lead in end of the winch line through the drum, manually pulling the lead in end through the rotating drum removing slack, and rotating the drum.

23 Claims, 7 Drawing Sheets

SECTION A-A

MANUAL MARINE WINCH WITH LEAD IN WEBBING STRAP

BACKGROUND OF THE INVENTION

1. Field of the Invention

The present invention relates to manual winches, and more particularly, to a manual marine winch having a lead in webbing strap.

2. Brief Description of the Prior Art

Winches have been used in many applications. Manual winches, including manual swivel winches, have been widely used in barges, tow boats and the like (collectively referred to as "boats"). Typically, a manual swivel marine winch is pivotally attached to a boat deck and spools a towing winch line, specifically a wire rope or cable, onto a rotatable drum. These manual marine winches often operate under relatively high tensions and have very sturdy constructions.

In conventional marine winch constructions, the tension or slack take up at the beginning of the tensioning operation requires a number of rotations of the drum and the wrapping of the winch line around the drum. This labor-intensive slack take up increases the time for the tensioning of the winch and must also be accounted for when paying out the load and when decoupling the winch line from the winch. In order to expedite the slack take up, large hand wheels have been added to existing winches to facilitate free wheeling, free wheeling essentially referring to rotation of the winch line onto the drum when minimum tension, i.e., slack take up, is on the winch line. Multiple layers of wire rope on the drum will also reduce the achievable tension of the drum and add the possibility of the payoff line becoming wedged in the lower wraps. There is a need in the art for an improved method of taking the slack out of a winch line during beginning of tensioning operations.

Another problem associated with the art is the speed in replacing a broken winch line. Due to the number of wraps of a conventional wire rope around a drum during tensioned operation, the replacement of a broken winch line becomes labor-intensive. With a broken winch line, the entire wrapped amount on the drum must be paid out, the winch line decoupled, and a new winch line put in place on the drum and on the coupled or towed barge, tow boat or the like. There is a need in the industry to provide a quick mechanism for easily replacing broken winch lines.

A further problem associated with the prior art is that the winch line, typically formed of a wire rope, is not easily seen by operators, particularly at night. A further safety disadvantage of existing winch lines is that existing winch lines cannot easily accommodate safety features such as material for increasing line visibility or load limits identification for quickly conveying this information to the user.

A final problem associated with prior art marine winches is deck space. Deck space is a premium on barges and all marine craft. Consequently, minimizing the size of the drum and associated components of a marine winch is very advantageous since the overall footprint and height of the resulting winch can be reduced.

It is an object of the present invention to provide a manual marine winch that expedites tension take up. It is a further object of the present invention to provide a winch with higher tensions possible with minimal operator effort. It is a further object of the present invention to provide a manual winch that simplifies the operation of the manual winch. It is another object of the present invention to provide a manual winch with safety indicators incorporated into the manual winch line. It is another object of the present invention to provide a manual winch with coupling mechanism for attachment to a variety of tie end lines. It is another object of the present invention to provide a manual marine winch that is compact and is economically manufactured.

SUMMARY OF THE INVENTION

The above objects are achieved with a marine winch according to the present invention. The manual marine winch includes a housing with an attachment mechanism for securing the winch to a boat deck. The manual marine winch includes a rotating drum mounted within the housing. The manual winch includes a mechanism for rotating and holding tension on the drum. Additionally, the manual winch includes a winch line having a lead in end adapted to be wound onto the drum, wherein the lead in end is formed by a webbing strap.

In one embodiment of the present invention, the webbing strap can include an integral safety indicator. The integral safety indicator may be load indicating indicia integral with the webbing strap, such as text woven therein. The integral safety indicator may include operating indicia indicative of operating extremes for beginning of the winding of the webbing strap onto the drum. For example, specifically, the operating indicia may be a colored stripe at either operative end of the webbing strap indicating how much of either end must extend beyond the drum at the beginning of the winding to accomplish the appropriate winding of the webbing strap onto the drum. The safety indicator may include reflective material integral with the webbing strap, such as being woven directly therein. The safety indicator or feature may be in the form of an abrasion resistant material incorporated into the webbing strap.

In the manual marine winch of the present invention, the drum may include a slot for receiving the webbing strap therethrough. Additionally, the drum may be formed of a significantly smaller diameter than a conventional winch, such as a four inch diameter drum, thereby saving valuable deck space. This provides increased tension on the winch with less effort due to reduced drum diameter. The drum diameter may be reduced due to virtually no minimum bending radius for the webbing strap. The attachment mechanism of the housing may include couplings for pivotally attaching the housing to the boat deck for 360° of rotation. Alternatively, the attachment mechanism may be in the form of a weldment welding the housing to the boat deck. Additionally, the mechanism for rotating and holding tension on the drum may include a gearing system coupled to the drum with at least one locking dog for holding tension on the drum.

In one embodiment of the present invention, the winch line of the webbing strap may include wire rope, chain or rope which is coupled to the webbing strap. A rotatable coupling or swiveling coupling may be utilized for coupling the webbing strap to the remaining portion of the winch line. The webbing strap may be 3 to 5 inches in width. The webbing strap of the present invention may include handles incorporated at the leading end thereof to assist in the manipulation of the webbing strap.

The manual marine winch with lead in webbing strap of the present invention provides an improved method for tensioning the winch line. The method of tensioning the winch line utilizing the manual marine winch of the present invention includes the steps of feeding a lead in end of the winch line through the rotating drum of the winch, manually pulling the lead in end of the winch line through the rotating drum to remove slack in the winch line, and rotating the drum of the winch to further tension the winch. This method provides an exceptionally fast and easy method of tensioning a winch line. A further advantage of the present invention is that upon failure of the winch line, the winch line can be easily be replaced. In particular, the webbing strap can be quickly replaced. Additionally, the winch is narrower and shorter than conventional marine winches saving deck space.

These and other advantages of the present invention will be clarified in the detailed description of the preferred embodiments together with the attached figures wherein like reference numerals represent like elements throughout.

DETAILED DESCRIPTION OF THE PREFERRED EMBODIMENTS

Figure 1:
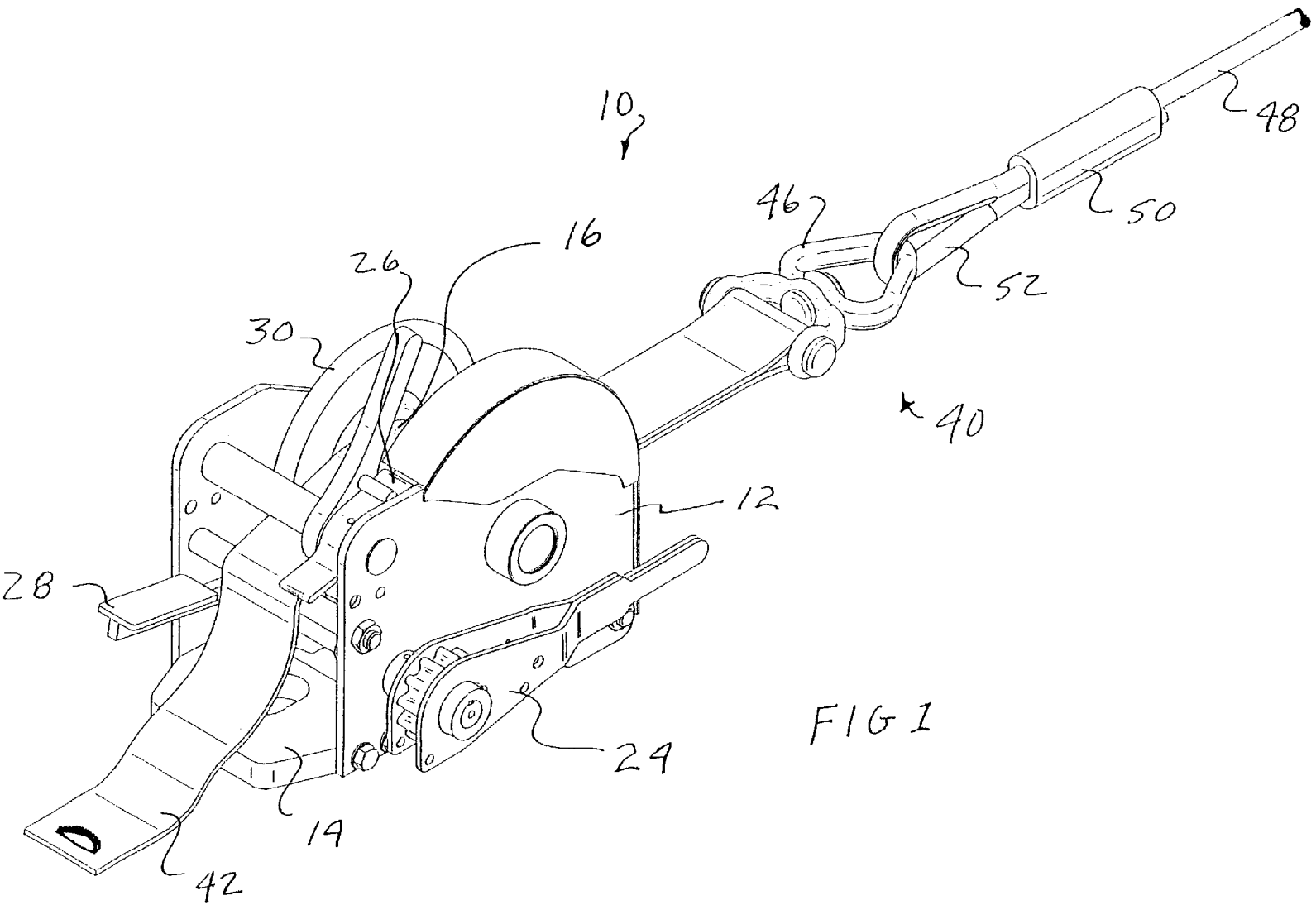
FIG. 1 is a perspective view of a manual marine winch with lead in webbing strap according to one embodiment of the present invention.
Figure 2:
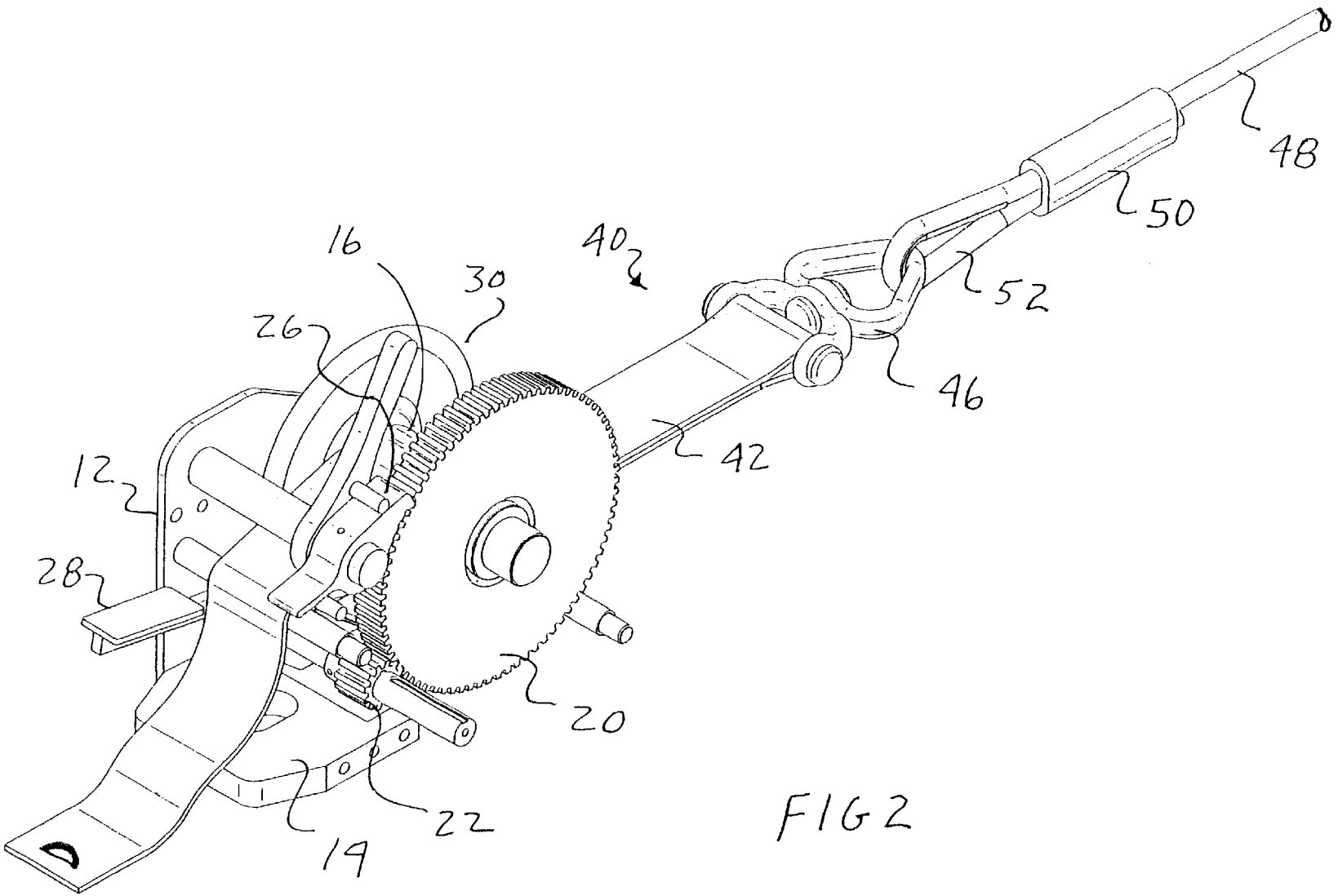
FIG. 2 is a perspective view of the manual marine winch shown in FIG. 1 with a portion of the housing removed.
Figure 3:
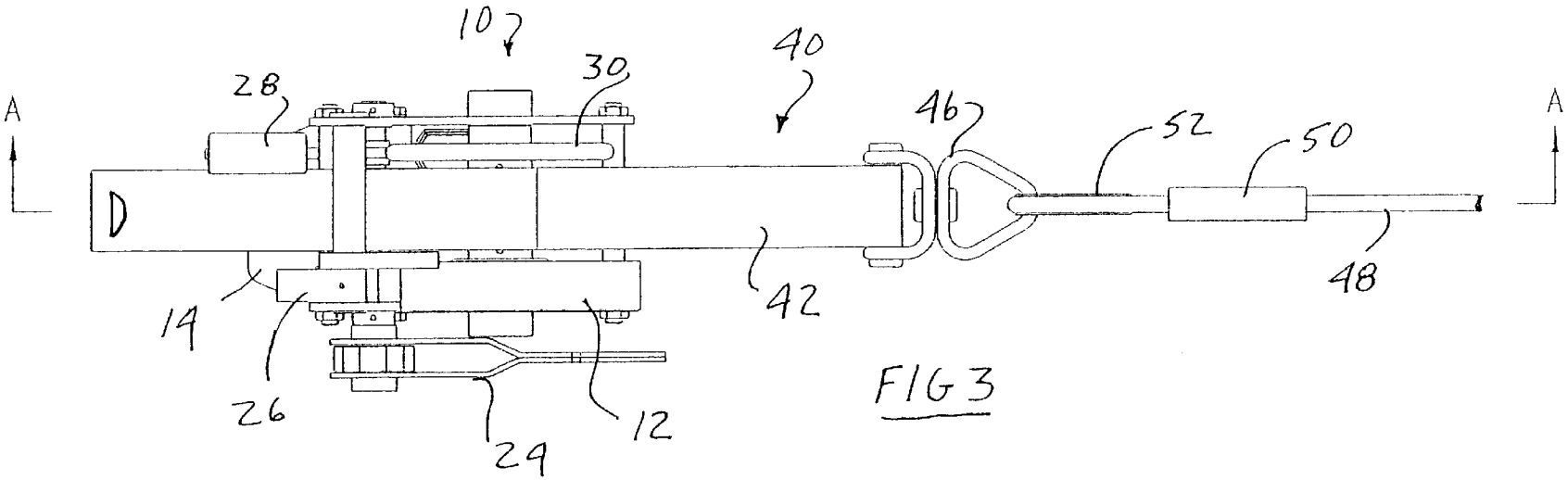
FIG. 3 is a top plan view of the manual marine winch illustrated in FIG. 1.
Figure 4:
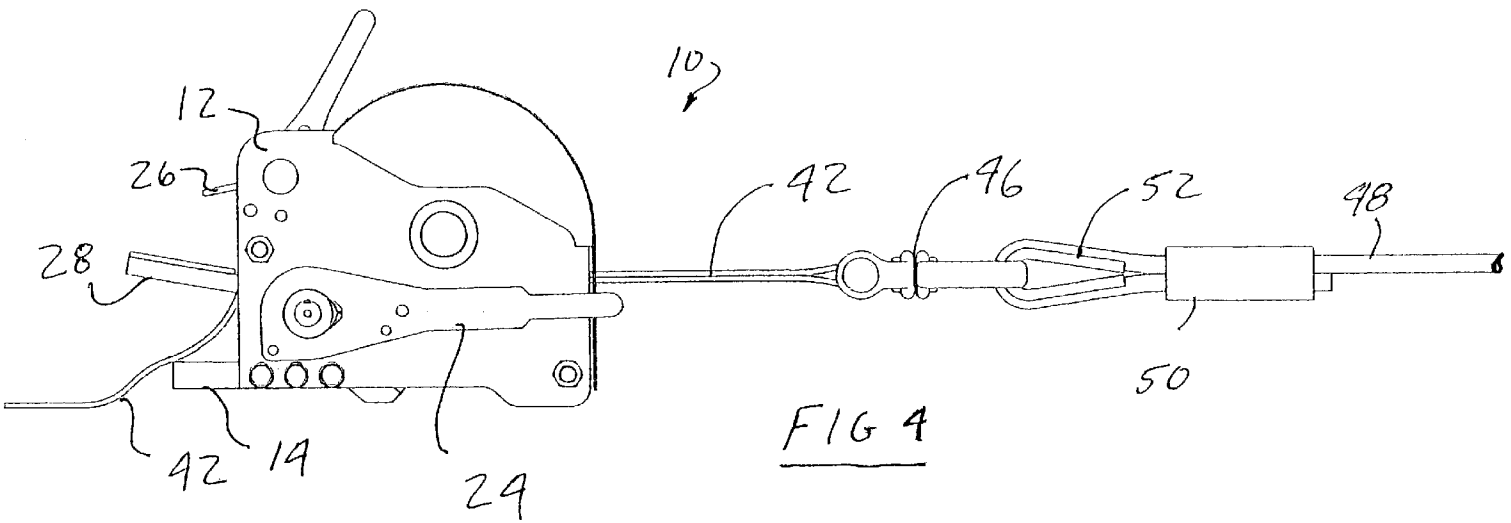
FIG. 4 is a side elevational view of the manual marine winch illustrated in FIG. 1.

FIGS. 1–4 illustrate a manual marine winch according to a first embodiment of the present invention. The winch 10 is a manual swivel marine winch and includes an open bottom structure. The construction and general operation of an open bottom manual swivel marine winch 10 is described in U.S. Pat. No. 5,947,450 issued to David Grapes which is incorporated herein by reference. In general, the winch 10 includes an open bottom housing 12 including a pair of spaced side plates together with a mechanism for attaching the winch 10 to a boat deck. The term boat deck is intended to generally refer to the deck of any marine vessel; however, the winch 10 will most commonly be utilized on barges. The attachment mechanism in the winch 10 includes a plate 14 between the side plates of the housing 12 for pivotally attaching the winch 10 to a D-ring or the like of a boat deck. The pivotal attachment allows the winch 10 to be a swivel winch meaning that the relative position of the winch 10 can rotate up to 360° about the connection to the boat deck. The attachment mechanism for the winch 10 may also be a weldment to fixedly attach the housing 12 to the boat deck.

A rotatable spool assembly is rotatably supported between the side plates of the housing 12. The spool assembly includes a rotatable drum 16 and a drum gear 20 coupled to the drum 16. The drum gear 20 can be seen in FIG. 2.

A drive pinion 22 meshes with the drum gear 20 and is manually rotatable through a conventional ratcheting lever assembly 24 mounted outside the housing as is well known in the art. Additionally, at least one locking dog 26 engages the drum gear 20 for holding tension on the winch 10 in a conventional fashion. A conventional had brake may also be utilized. Conventional drum foot brake 28 and hand wheel 30 (which is formed as a flange on the drum 16) may also be provided for conventional operation of the winch 10. The hand wheel 30, formed by the drum flange, is more compact than separate hand wheels attached to the exterior of some existing winches. The hand wheel 30, foot brake 28, locking dog 26, ratcheting lever assembly 24, drive pinion 22 and drum gear 20 combine to form a conventional mechanism for rotating and holding tension on the drum 16 as will be well known in the art. The drive pinion 22 and drum gear 20 form a gearing system often utilized in marine winches and is also believed to be well known. The operation and features of these conventional components will not be described further. A detailed explanation of these features are provided in U.S. Pat. No. 5,947,450, incorporated herein by reference as discussed above. Additionally, these features can be found in marine winches sold by W. W. Patterson Company and others in the industry.

Figure 5:
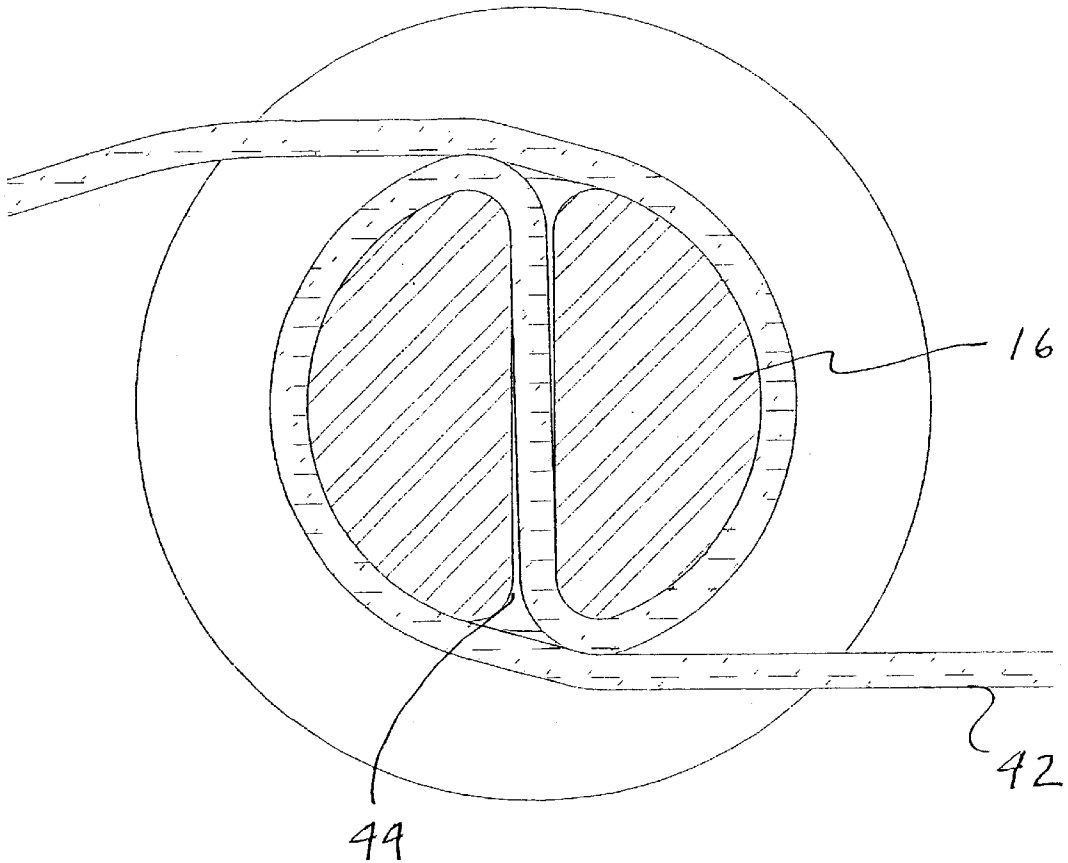
FIG. 5 is a schematic sectional view of the webbing strap and drum in the manual marine winch illustrated in FIG. 1.
Figure 6:
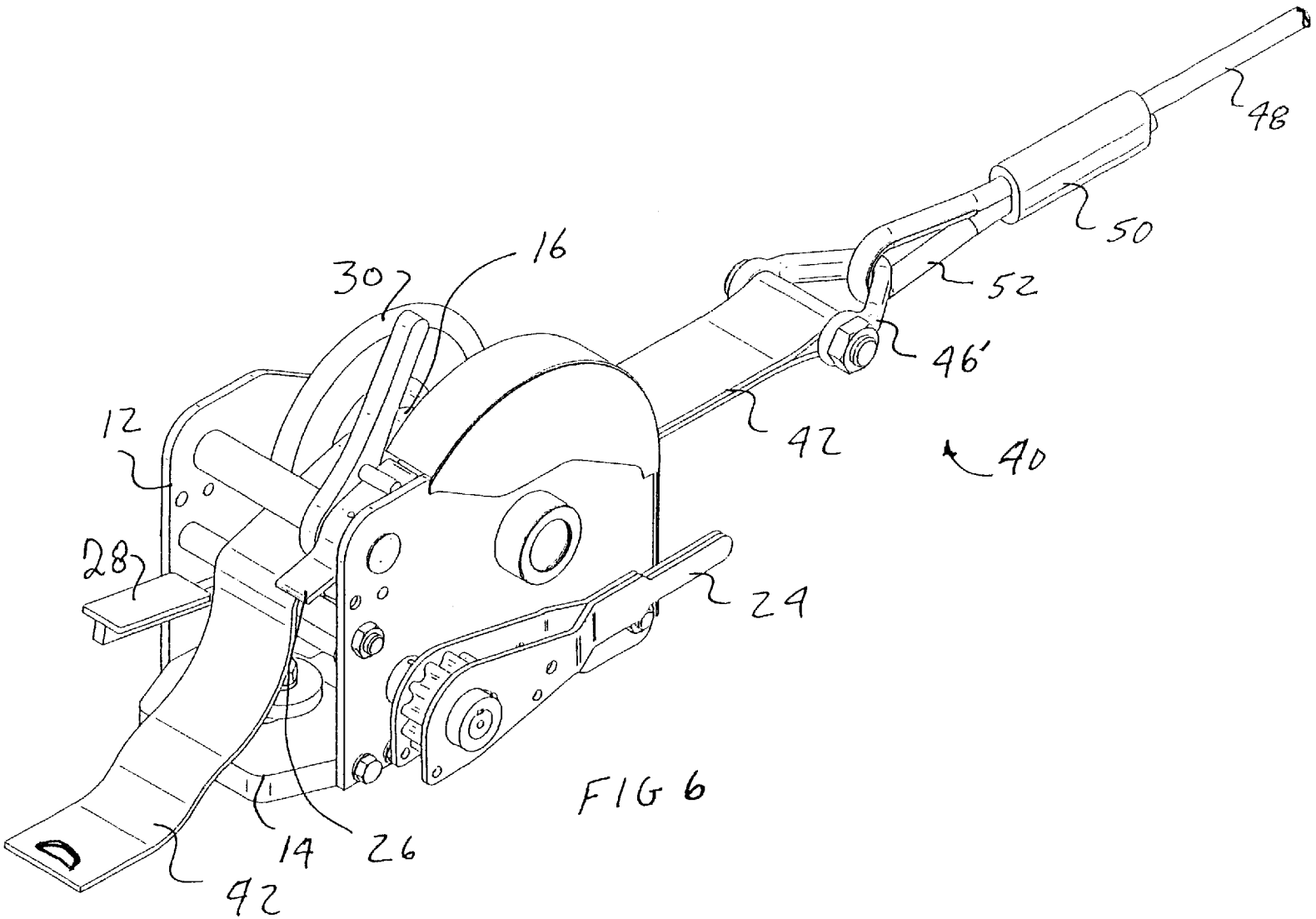
FIG. 6 is a perspective view of a manual marine winch according to a second embodiment of the present invention.

The winch 10 according to the present invention has a winch line 40 extending from the housing 12 to the barge, towboat, or other element to be connected to the boat deck through the winch 10. As discussed above, conventionally, marine winches utilize a wire rope or cable wrapped around the drum at least on the lead in end of the winch line. The winch 10 forms the lead in end of the winch line 40 by a webbing strap 42. The webbing strap 42 is fed through a slot 44 in the drum 16 (shown in FIG. 5) prior to wrapping the webbing strap 42 around the drum 16. The slot 44 is rounded at the entrance and exit thereof to prevent damage to the webbing strap 42. The webbing strap 42 is coupled to a trailing or tie down end of the winch line 40 through swivel connection 46 coupling the webbing strap 42 to wire rope 48. The end of the wire rope 48 may have a loop formed with a swaged fitting 50 and a thimble 52 in the loop adjacent to the swivel connection 46. The portion of the wire rope 48 beyond the swage fitting 50 is essentially conventional. Fig 6 illustrates a second embodiment of the winch 10 in which the swivel connection 46 is replaced with a non-swiveling connection 46'.

It is expected that the winch line 40 for the winch 10 of the present invention can be formed of a webbing strap 42 coupled through an appropriate connection to any appropriate material for forming the trailing end of the winch line 40 such as chain, conventional rope, or other known line materials. It is even envisioned that the entire winch line 40 may be formed of a webbing strap 42. The formation of the trailing end of the winch line 40 will depend on the desired operation of the winch 10. The coupling formed by swivel connection 46 and connection 46' allows the winch 10 utilizing the webbing strap 42 to be associated with any conventional line such as wire rope 48.

In operation, the provision of the webbing strap 42 provides substantial advantages to the efficient operation of the winch 10 of the present invention. Specifically, in operation, once the trailing end of the winch line 40 formed by the wire rope 48 is coupled to the adjacent barge or the like, the lead in end of the winch line 40 formed by webbing strap 42 is fed through slot 44 by the operator. The operator then will pull the webbing strap 42 through the slot 44 to take up the slack in the winch line 40 in a very quick and efficient manner. Once the slack has been taken up, the drum 16 can be rotated using the ratcheting lever assembly 24 in a conventional manner. Once the webbing strap 42 begins to wrap on itself, the tension will be held on the drum 16. It is contemplated that only 270° to 360° of rotation will be necessary for holding in most applications. However, multiple wraps of the webbing strap 42 around the drum 16 may be provided for very securely holding the tension on the drum 16 to prevent pull through of the webbing strap 42 (i.e., slippage). In addition to the significant advantage in speed of taking up tension in use of the winch 10, the winch 10 allows for very quick replacement of a broken winch line 40. Through use of the swivel connector 46, a broken webbing strap 42 or broken wire rope can be very easily replaced. It is expected that the webbing strap 42 can be replaced with greater ease than the associated trailing end of the winch line 40 formed by wire rope 48. Consequently, it is possible that the webbing strap 42 be designed to fail prior to the failure point of the wire rope 48 to further ease in the replacement of broken winch lines 40.

Figure 8:
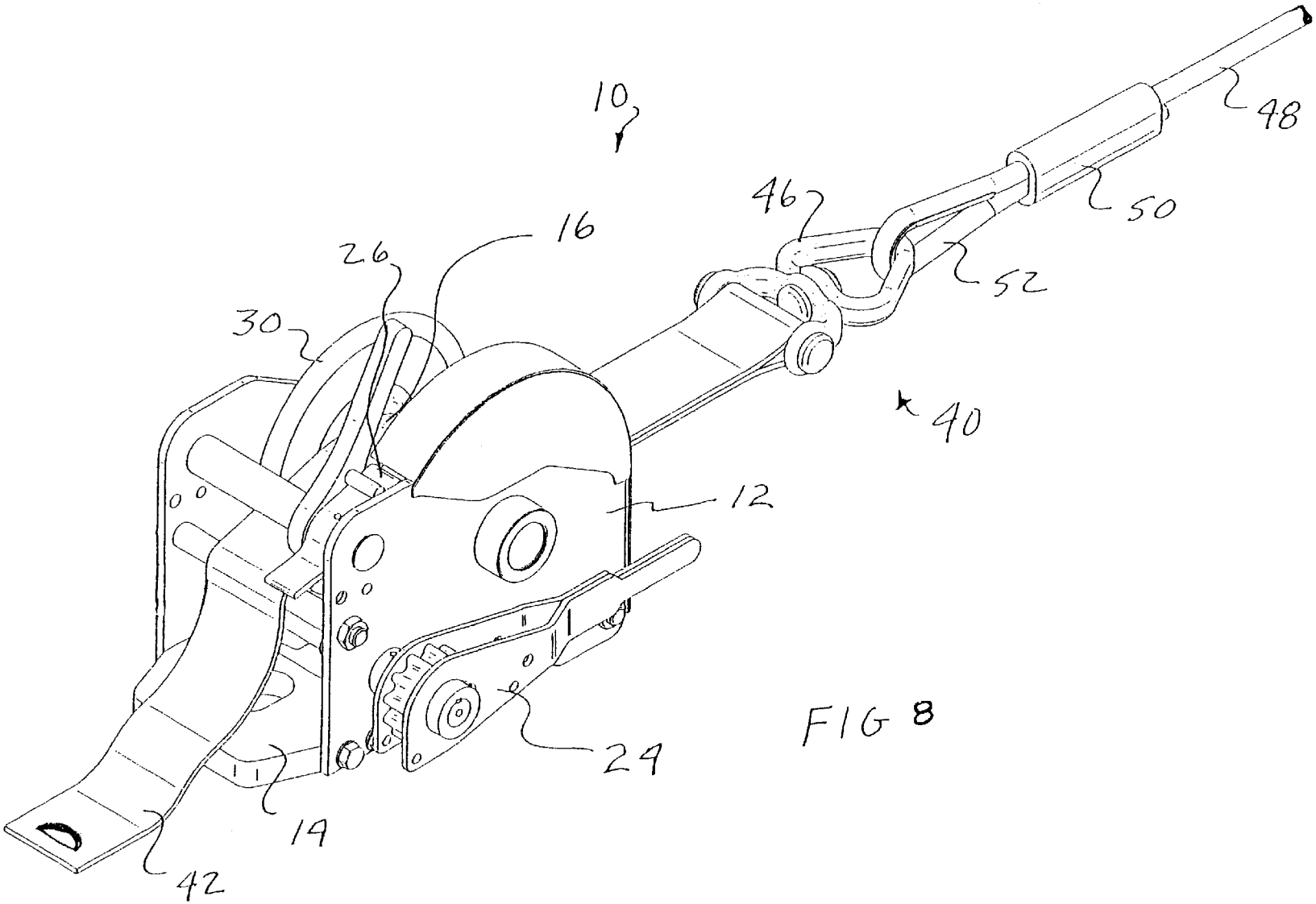
FIG. 8 is a perspective view of a manual marine winch according to a third embodiment of the present invention.

Another advantage of the webbing strap 42 is that the drum 16 may be smaller than a conventional winch drum reducing the size of the winch 10. For example, the drum 16 may be on the order of 4 inches in diameter or even less. The width of the winch 10 may be reduced due to the use of the webbing strap 42 further reducing the footprint of the winch 10. Additionally, the elimination of wire rope on the drum may allow the formation of a brakeless winch 10 as shown in FIG. 8 which will further reduce the size and cost of the winch 10. This embodiment will be described further below.

Figure 7:
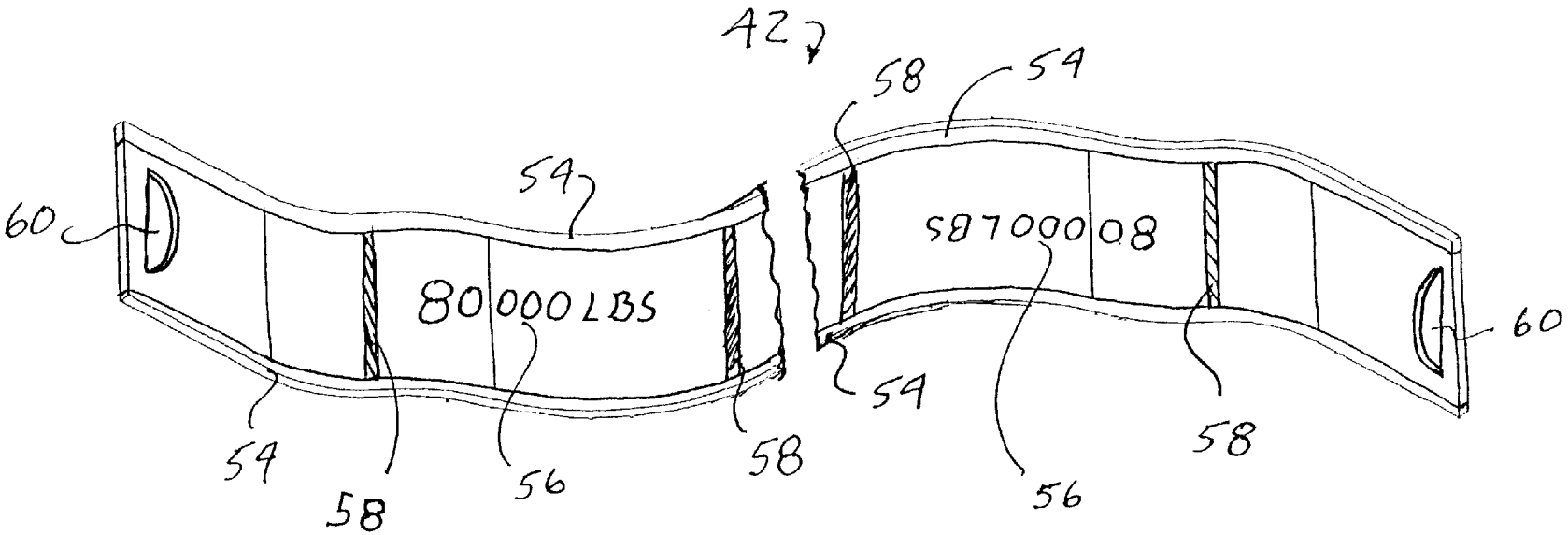
FIG. 7 is a schematic view of a webbing strap for a manual marine winch according to the present invention.

The use of webbing strap 42 as a lead in end of the winch line 40 provides other substantial advantages to the winch 10 of the present invention. Specifically, the webbing strap 42 allows the lead in end of the winch line 40 to include integral safety indicators. Specifically, the webbing can be formed of a brighter material to increase day visibility. As shown in FIG. 7, reflective strips 54 formed by yarn may be woven directly into the sides of the webbing strap 42 to increase night visibility. It is also anticipated that with the use of webbing strap 42, the reflective strip 54 could be replaced with a reflective tape subsequently attached to the webbing strap 42. However, the weaving of such a feature directly into the webbing strap is believed to provide certain advantages preventing the wearing off of the reflective strip 54. A further integral safety indicator is a load rating indicia 56, such as text, woven or formed directly in the webbing strap 42. Incorporating a load rating indicia 56 directly onto the webbing strap 42 will provide the operator with an easy indication of the operating parameters of the winch line 40 and the associated winch 10. The load indicating indicia 56 may preferably be text, as shown; however, symbols, color codes or other techniques could also be used. Conventional winch lines do not have this capability of easily integrating such features into the winch line itself. A further integral safety indicator or feature is abrasive-resistant yarn which can be utilized to form all of, or the edges of, the webbing strap 42 to prevent undo wear of the webbing strap 42. It is expected that the webbing strap 42 would be approximately 3 inches wide and 0.6 inches in thickness. The width of 3 inches will minimize the width of the winch 10. As discussed above, the forming of the webbing strap 42 as a safety yellow color or white color together with the reflective strip 54 will increase visibility and minimize the tripping hazard. The preferred width of the webbing strap is expected to be 3 to 5 inches in width, although wider widths are possible. Even narrow widths are possible depending on the number of wraps desired and the thickness of the webbing strap and the desired load carrying capacity of the webbing strap.

The webbing strap 42 can utilize a variety of fibers including polyester, nylon, spectra, vectra and other known material. Appropriate webbing or strapping material for the webbing strap 42 can be found from strapping manufacturers such as Murdock Webbing Company. The webbing strap 42 may additionally incorporate handles 60 on the extreme ends thereof to assist the operator in pulling the lead in through the drum 16. As shown in FIG. 7, it is expected that the webbing strap 42 will be formed of a single-ply strapping about 15 feet in length that is doubled over so that handles at the ends thereof are aligned. This represents the easiest construction. Alternatively, a loop may be formed at one end of the webbing strap 42 for attachment to the swivel connection 46. Additionally, the webbing strap 42 may include a safety stripe 58 at the trailing end as well as at the end adjacent the swivel connection 46 to indicate to the user when there is sufficient length of the webbing strap 42 on either side of the drum 16 for safely winding and holding tension on the drum. As will be understood by a review of the operation, upon beginning of the drum turning operation after the original slack has been taken up, the webbing strap 42 would pull in from the trailing end through the drum 16 until it begins to overlap. Upon overlapping it will of course need a certain length of material between the drum 16 and the swivel connection 46 to accomplish the desired number of wraps. The location of the safety stripe 58 will depend upon the specific diameter of the drum 16. A single webbing strap 42 may be designed for use with different winches 10 having different drum diameters. In such a case, safety stripes 58 for each size drum could be placed on the webbing strap 42 and color-coded.

Another advantage of the winch 10 of the present invention is that it largely utilizes existing winch technology. The only modification of an existing winch to the winch 10 of the present invention is replacing the existing winch line with the winch line 40 of the present invention and replacing the existing drum with a rotating drum having a slot 44 or other attachment mechanism for receiving the webbing strap 42. Consequently, a wide variety of existing manual winches may be easily retrofitted by replacing the drum and winch line to form a manual marine winch 10 having a lead in webbing strap 42 according to the present invention.

As discussed above, the winch 10 of the present invention provides a quick and easily operated winch operating substantially faster than the prior art. The winch 10 provides a smaller winch that is narrower and shorter than prior art winches providing a smaller footprint and thereby minimizing deck space usage. The winch 10 may also be used as an unbraked winch. Without the use of brake 28, the release of tension on the drum 16 by knocking out the locking dog 26 will cause the webbing strap 42 to wind back up onto the drum 16 due to inertia of the drum 16, essentially going from an underwinding position to an overwinding position on the drum 16. This will provide a self braking feature to the winch 10. Any additional tension in the winch line 40 will pull the webbing strap 42 and the drum 16 from the overwrapped position. Consequently, the drum 16 may oscillate between the normal underwrapped and the overwrapped directions, but the majority of the tension in the winch line 40 will be released in the initial rotation from the underwrapped to the overwrapped position. This feature of the winch 10 will allow the elimination of the foot brake 28 (or hand brake) as shown in FIG. 8, further minimizing the space and cost of the winch 10.

The invention has been described with reference to the preferred embodiment. Obvious modifications and alterations will occur to others upon reading and understanding the proceeding detailed description. For example, a removable stop can be added to the webbing strap 42 after feeding through the drum 16 to prevent the strap 42 from being inadvertently pulled back through the drum 16. The removable stop can be easily secured through the handle 60, and may be formed by a removable padlock or the like. It is intended that the invention be construed as including all such modifications and alterations insofar as they come within the scope of the appended claims or the equivalents thereof.

What is claim is:

1. A manual marine winch comprising:

a housing having an attachment mechanism for securing the winch to a boat deck;

a rotating drum mounted in the housing;

a mechanism for rotating and holding tension on the drum; and a winch line having a lead in end adapted to be wound onto the drum, wherein the lead in end is formed by a webbing strap, wherein the strap includes a strap receiving and holding structure.

2. The winch as claimed in claim 1 wherein the attachment mechanism pivotably attaches the housing to the boat deck.

3. The winch as claimed in claim 2 wherein the mechanism for rotating and holding tension on the drum includes a gearing system coupled to the drum and at least one locking dog for holding tension on the drum.

4. The winch as claimed in claim 1 wherein the webbing strap includes an integral safety indicator.

5. The winch as claimed in claim 4 wherein the safety indicator includes load indicating indicia.

6. The winch as claimed in claim 4 wherein the safety indicator includes operating indicia indicative of operating extremes for beginning of the winding of the webbing strap onto the drum.

7. The winch as claimed in claim 4 wherein the safety indicator includes reflective material.

8. The winch as claimed in claim 4 wherein the safety indicator includes abrasion resistant material in the webbing strap.

9. The winch as claimed in claim 1 wherein the strap receiving and holding structure of the drum includes a slot receiving the webbing strap there through.

10. The winch as claimed in claim 1 wherein the winch line includes one of the group consisting of wire rope, chain and rope coupled to the webbing strap.

11. The winch as claimed in claim 1 wherein the webbing strap is at least 3" wide.

12. A manual marine winch comprising:

a housing having an attachment mechanism for securing the winch to a boat deck;

a rotating drum mounted in the housing; a mechanism for rotating and holding tension on the drum; and a winch line having a lead in end adapted to be wound onto the drum, wherein the lead in end includes an integral safety indicator, wherein the safety indicator includes reflective material integral with the lead in end of the winch line.

13. The winch as claimed in claim 12 wherein the safety indicator includes load indicating indicia integral with the lead in end of the winch line.

14. A manual marine winch comprising:

a housing having an attachment mechanism for securing the winch to a boat deck;

a rotating drum mounted in the housing; a mechanism for rotating and holding tension on the drum; and a winch line having a lead in end adapted to be wound onto the drum, wherein the lead in end includes an intearal safety indicator, wherein the safety indicator includes operating indicia indicative of the range of winch line positions for beginning of the winding of the winch line onto the drum integral with the lead in end of the winch line.

15. The winch as claimed in claim 12 wherein the drum includes a slot winch line there through.

16. The winch as claimed in claim 12 wherein the lead in end includes a webbing strap and the winch line further includes one of the group consisting of wire rape, chain and rope coupled to the webbing strap.

17. A lead in end of a marine winch line for coupling to and wrapping on a drum of a manual marine winch, wherein the lead in end is formed by a webbing strap configured to provide quick tension take up on the marine winch, wherein the webbing strap includes operating indicia indicative of the range of proper location of the webbing strap for beginning of the winding of the winch line onto the drum that is integral with the lead in end of the winch line.

18. The lead in end of a winch line as claimed in claim 17, wherein the webbing strap includes load indicating indicia integral with the webbing strap.

19. The lead in end of a winch line as claimed in claim 17, wherein the lead in end of a winch line includes a coupling for attachment to one of the group consisting of wire rope, chain and rope, and wherein the webbing strap is configured to fail before the remaining elements of the winch line.

20. The lead in end of a winch line as claimed in claim 17, wherein the lead in end of a winch line includes an integral grab handle adjacent one end thereof.

21. The lead in end of a winch line as claimed in claim 17, wherein the webbing strap includes an integral safety indicia and a removable stop attached to an end thereof to prevent the webbing strap from being inadvertently pulled through the drum.

22. A method of tensioning a winch line on a manual marine winch comprising the steps of:

feeding a lead in end of the winch line through a slot extending from one peripheral side of the rotating drum to an opposite peripheral side of the rotating drum of the winch;

manually pulling the lead in end of the winch line entirely through the rotating drum through the slot to remove slack in the winch line; and rotating the drum of the winch.

23. A method of modifying a marine winch having a drum and a winch line, the method comprising the steps of:

replacing the drum with a drum having a slot extending entirely therethrough adapted to receive a webbing strap therethrough; and replacing the winch line with a winch having a lead in end formed of a webbing strap for receipt through the slot of the drum.

* * * * *

UNITED STATES PATENT AND TRADEMARK OFFICE

CERTIFICATE OF CORRECTION

PATENT NO. : 6,938,881 B2
APPLICATION NO. : 09/965788
DATED : September 6, 2005
INVENTOR(S) : David B. Grapes It is certified that error appears in the above-identified patent and that said Letters Patent is hereby corrected as shown below:

Column 8
Lines 5-12 should read

--rotating and holding tension on the drum; and a winch line having a lead in end adapted to be wound onto the drum, wherein the lead in end includes an integral safety indicator, wherein the safety indicator includes operating indicia indicative of the range of winch line positions for beginning of the winding of the winch line onto the drum integral with the lead in end of the winch line.--

Column 8
Lines 13-14

15. The winch as claimed in claim 12 wherein the drum includes a slot receiving the winch line there through.

UNITED STATES PATENT AND TRADEMARK OFFICE

CERTIFICATE OF CORRECTION

PATENT NO. : 6,938,881 B2
APPLICATION NO. : 09/965788
DATED : September 6, 2005
INVENTOR(S) : David B. Grapes It is certified that error appears in the above-identified patent and that said Letters Patent is hereby corrected as shown below:

Column 8
Lines 15-18

16. The winch as claimed in claim 12 wherein the lead in end includes a webbing strap and the winch line further includes one of the group consisting of wire rope, chain and rope coupled to the webbing strap.

Signed and Sealed this

Twenty-fifth Day of December, 2007

JON W. DUDAS
*Director of the United States Patent and Trademark Office*